US006173783B1

(12) United States Patent
Abbott-Brown et al.

(10) Patent No.: US 6,173,783 B1
(45) Date of Patent: Jan. 16, 2001

(54) METHOD OF COMPLETING AND PRODUCING HYDROCARBONS IN A WELL

(76) Inventors: John Abbott-Brown, 519 Diamond Bay SE., Calgary, Alberta (CA), T2J 3H7; Jim Zemlak, 44 Sun Harbour Crescent SE., Calgary, Alberta (CA), T2X 3B2

( * ) Notice: Under 35 U.S.C. 154(b), the term of this patent shall be extended for 0 days.

(21) Appl. No.: 09/312,838

(22) Filed: May 17, 1999

(51) Int. Cl.[7] ..... E21B 43/17
(52) U.S. Cl. ..... 166/370; 166/373; 166/308
(58) Field of Search ..... 166/372, 370, 166/308, 371, 373, 400, 401, 271

(56) References Cited

U.S. PATENT DOCUMENTS 3,613,792 * 10/1971 Hyde et al. ..... 166/57
3,706,344 * 12/1972 Vann ..... 166/297
3,800,705 * 4/1974 Tamplen ..... 175/4.54 X
4,554,981 * 11/1985 Davies ..... 175/4.52
5,971,069 * 10/1999 Stoy et al. ..... 166/250.03

* cited by examiner

*Primary Examiner*—Frank Tsay

(57) ABSTRACT

This invention relates to a method for completing and producing hydrocarbons from a well through the use of extreme overbalanced pressure during perforation of the casing string, followed by an underbalanced surge to produce the hydrocarbons through the tubing string.

7 Claims, 6 Drawing Sheets

METHOD OF COMPLETING AND PRODUCING HYDROCARBONS IN A WELL

FIELD OF THE INVENTION

This invention relates generally to the field of drilling for hydrocarbons such as oil and gas. More specifically, this invention relates to a method for completing and producing hydrocarbons through the use of extreme overbalance pressure followed by an underbalance surge.

BACKGROUND OF THE INVENTION

When drilling for hydrocarbons such as oil and gas in a subterranean formation, a wellbore is drilled into the formation for the purpose of gaining access to the hydrocarbons. Drilling mud is often used to assist in the drilling process and to hydrostatically suppress the flow of fluids into the well from a pressurized formation. A casing is installed and cemented to the face of the wellbore. During this process the drilling mud is, for the most part, replaced with water. The casing blocks the flow of fluid from the formation into the wellbore. Charges are then detonated so as to cause perforations in the well casing and cement. These perforations extend into the formation and permit the influx of the hydrocarbons into the well. The perforation is typically carried out using a perforating gun.

Perforation can be conducted in "overbalanced" conditions where the well pressure is greater than the pressure at which the formation will fracture. The term "underbalance" is used to refer to a situation where the pressure of liquid in the wellbore is less than the pressure existing in the formation.

After the perforations have been created, the drilling mud is gradually displaced by the influx of hydrocarbons and the hydrocarbons eventually flow into the wellbore and then up to the surface.

Conventional drilling methods and assemblies suffer from certain disadvantages. For example, it can be problematic to clean the perforations of mud filtrate, cement contaminates and perforation debris. In standard extreme overbalance perforating applications it is not possible to surge the well prior to flowing the well back to surface.

These and other deficiencies in the prior art have been addressed by the present invention.

SUMMARY OF THE INVENTION

In a first aspect, the present invention provides a method of completing and producing hydrocarbons in a well, the well having a casing string extending into a wellbore and penetrating a hydrocarbon-bearing formation, a tubing string extending downhole into the casing string, the strings forming an annulus between them which annulus is sealed in one portion by a packer, the tubing string having a bore and ports in its surface located downhole of the packer, the tubing string having valve means located downhole of the ports for selectively trapping or releasing pressure in the tubing string downhole of the valve means, means for perforating the casing string being located at the tubing string's lower end and downhole of the valve means, the casing string initially blocking communication of the hydrocarbons with the wellbore, the method comprising: blocking the ports in the tubing string so as to prevent fluid communication between the casing string and the tubing string; creating a fluid column in the tubing string's lower end; adding a sufficient volume of a gas to the fluid column to achieve a predetermined downhole pressure which will exceed the fracture gradient of the formation; perforating the casing at the hydrocarbon-bearing formation so as to fracture the formation; maintaining pressure below the packer through the use of the valve means; removing sufficient volumes of the gas from the well so that it is in an underbalanced state; opening the ports so as to release the pressure below the packer and allow it to surge into the tubing string, thus permitting a mixture of hydrocarbons and gas to surge up the tubing string to the surface.

The gas used may be nitrogen, carbon dioxide or any other suitable gas. The valve may comprise a flapper valve. If desired, an additional volume of gas may be pumped into the tubing string after perforation to further fracture the formation.

DETAILED DESCRIPTION OF THE PREFERRED EMBODIMENT

Figure 1:
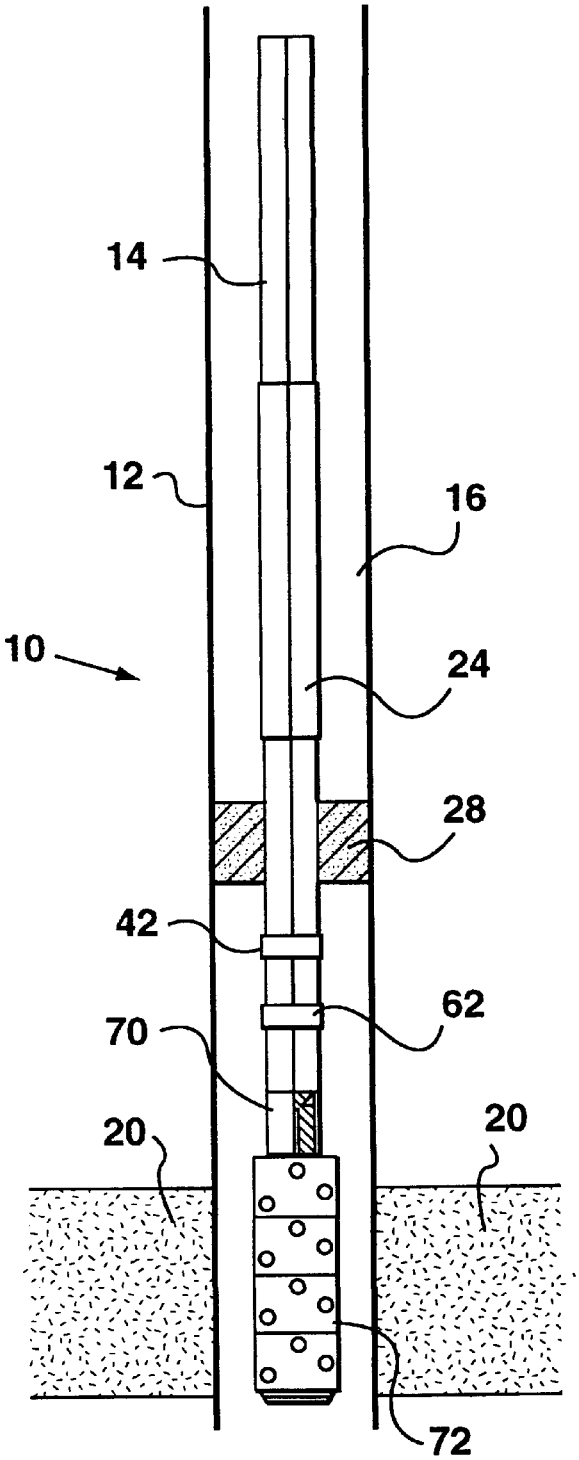
FIG. 1 is a perspective view of the installed tubing conveyed perforating assembly of the present invention, prior to perforation of the assembly and the introduction of gas.

FIG. 1 illustrates a conventional well 10 comprising a casing string 12, and tubing string 14 extending downwardly inside the bore of the casing forming an annulus 16 between the casing and tubing. The casing extends into a formation 20 which contains hydrocarbons such as oil or gas. A cement sheath holds the casing in place in the hole which has been drilled in the ground.

Figure 9:
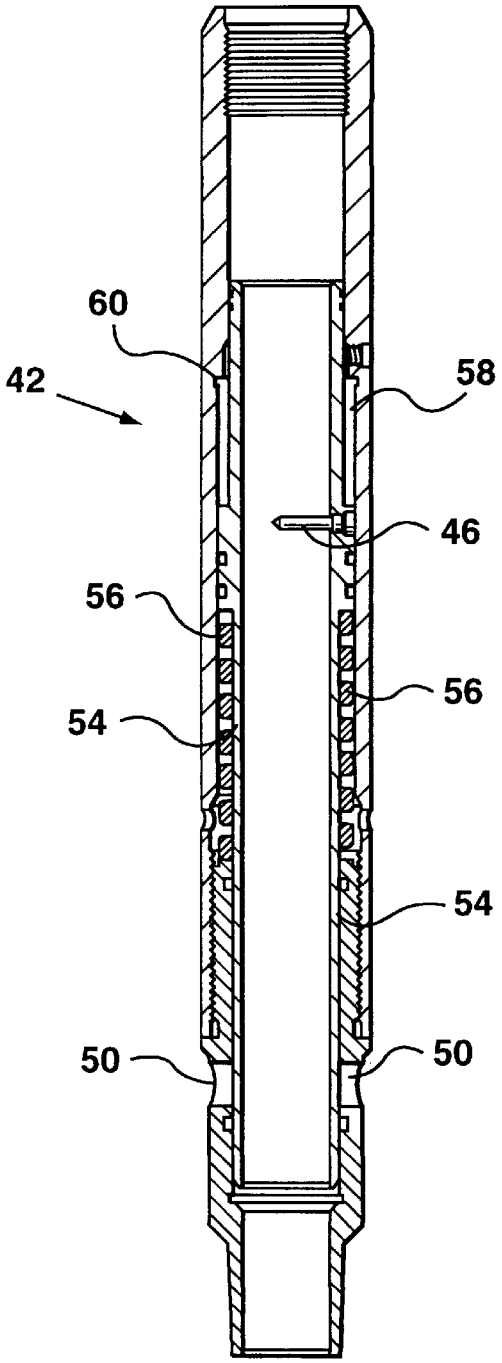
FIG. 9 is a cross-sectional view of the bar actuated vent in the closed position.

The tubing has a bore 24. Together, the annulus 16 and the tubing bore 24 form the wellbore. Packer 28 is positioned between casing 12 and tubing 14 to seal annulus 16. Fluid may be inserted into the annulus 16 between the tubing and the casing above the packer 28 in order to reduce the difference in pressure between the formation 20 and the inside of the casing. Located downhole of the packer 28 is bar actuated vent 42, shown in more detail in FIG. 9. Vent 42 is in the shape of a hollow cylinder with a pin 46 extending into the interior of the vent. Ports 50 permit fluid communication between the interior of the tubing and the annulus 16. In FIGS. 1 and 9, vent 42 is in the closed position. In the closed position, sleeve 54 obstructs the ports 50 in the vent 42 and prevents fluid communication with the annulus 16. As described below, vent 42 may be opened by breaking the pin 46 after which spring 56 causes sleeve 54 to move upwards into recess 58 until shoulder 60 prevents further upward movement of the sleeve 54. In this open position, ports 50 are unobstucted by the sleeve 54 so as to permit the displacement of wellbore fluid.

It can thus be seen that vent 42 can replace a standard surge tool and results in the tubing being kept dry. The vent 42 can be used in an underbalance application or in an extreme overbalance perforation system and does not depend on tubing hydrostatic pressure to operate. The vent 42 can be used in wells with open perforations to achieve an underbalance when the guns fire to add a surge.

Figure 10:
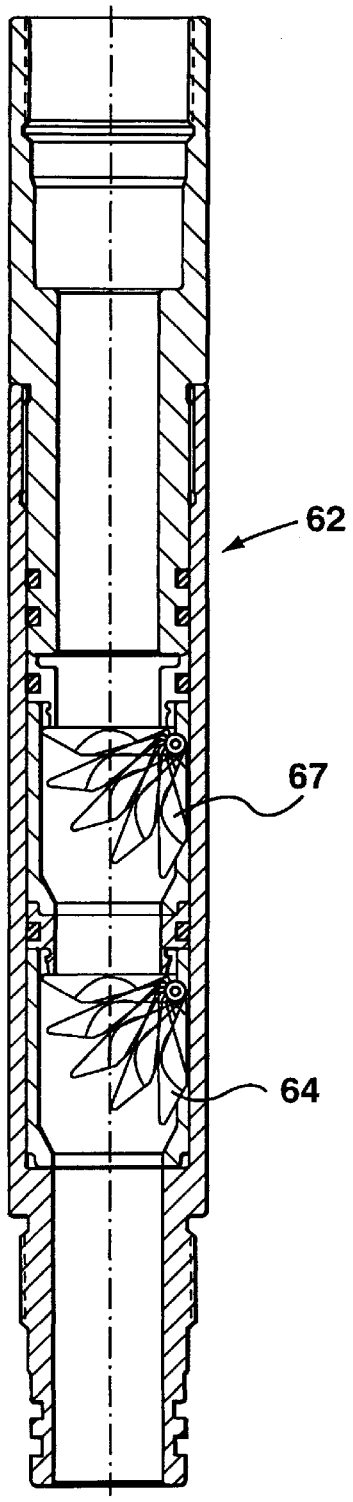
FIG. 10 is a cross-sectional view of the check valve tool.

Check valve tool 62, shown in FIGS. 1 and 10, is located downhole of the bar actuated vent. Check valve tool 62 is a valve of the type known as a flapper valve and is of a generally cylindrical shape. In FIG. 1, the check valve tool is in the closed position. FIG. 10 illustrates the check valve tool in various positions. Flappers 64 are hinged at the sides of the check valve tool and, as shown in FIG. 10, open downward. In FIG. 10, each of two flappers 64 are shown in five different positions, moving in a counter-clockwise motion from a closed position (horizontal) to an open position (vertical).

Automatic venting firing head 70 and perforating gun 72 are also shown in FIG. 1, downhole of the check valve tool.

Figure 2:
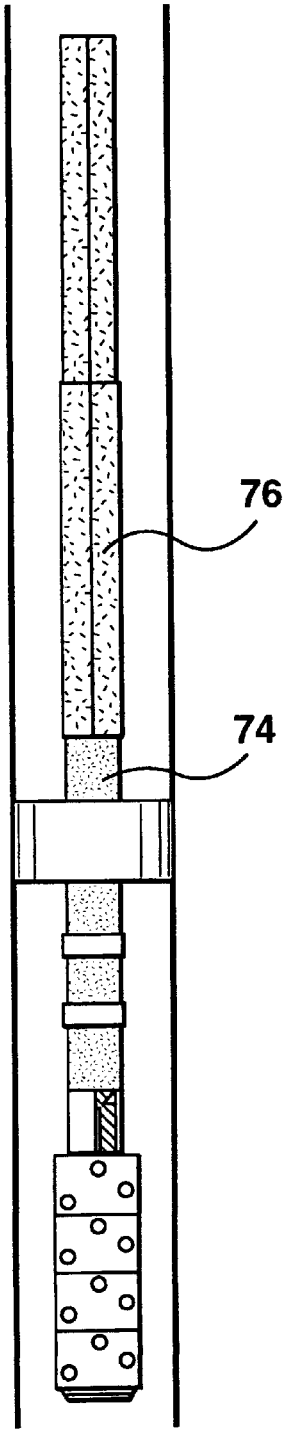
FIG. 2 is a perspective view of the assembly in which fluid and nitrogen gas has been introduced into the tubing.

FIG. 2 illustrates the introduction of fluid and liquid nitrogen into the tubing. The fluid is formation specific. For example, fluids such as a mixture of potassium chloride and water, methanol or frac oil are just some of the fluids which may be used depending upon the physical composition of the formation. The process is initiated by trickling an amount of fluid into the tubing on top of the firing head 70, thus creating fluid column 74. Typically, it is necessary to use anywhere from 1 to 5 barrels of fluid so as to create a fluid column of roughly 200 to 300 meters in height. Each barrel contains approximately 42 gallons or 0.1590 cubic meters of fluid. The amount of fluid which is trickled into the tubing varies from well to well, depending upon such factors as the depth of the well, type of formation and the pressures which are encountered in the well. After the creation of the fluid column, a volume of nitrogen 76 is then introduced to the tubing The volume of nitrogen which is needed again varies depending upon the type of well but is calculated to create an overbalance condition with respect to fracturing the formation. In FIG. 2, check valve tool 62 is open. Referring to FIG. 10, flappers 64 would be facing vertically downward when check valve tool 62 is in the open position.

Figure 3:
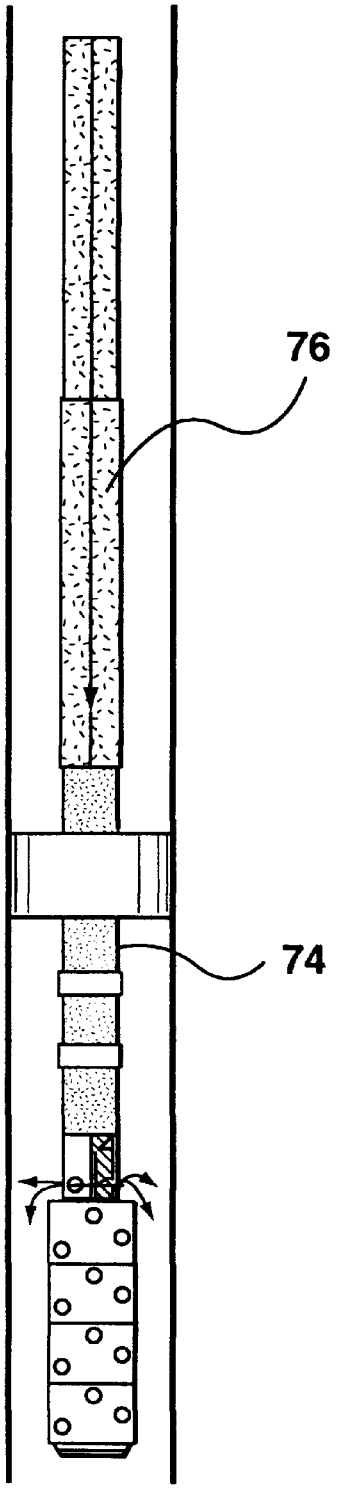
FIG. 3 is a perspective view of the assembly after detonation has occurred and the firing head vent has opened.

FIG. 3 illustrates the detonation of the charges and the opening of the firing head. As is well known in the industry, charges are detonated so as to cause perforations in the well casing and cement. These perforations extend into the formation and permit the influx of the hydrocarbons into the well. Activation of the firing head causes a drop in pressure within the tubing.

Figure 11:
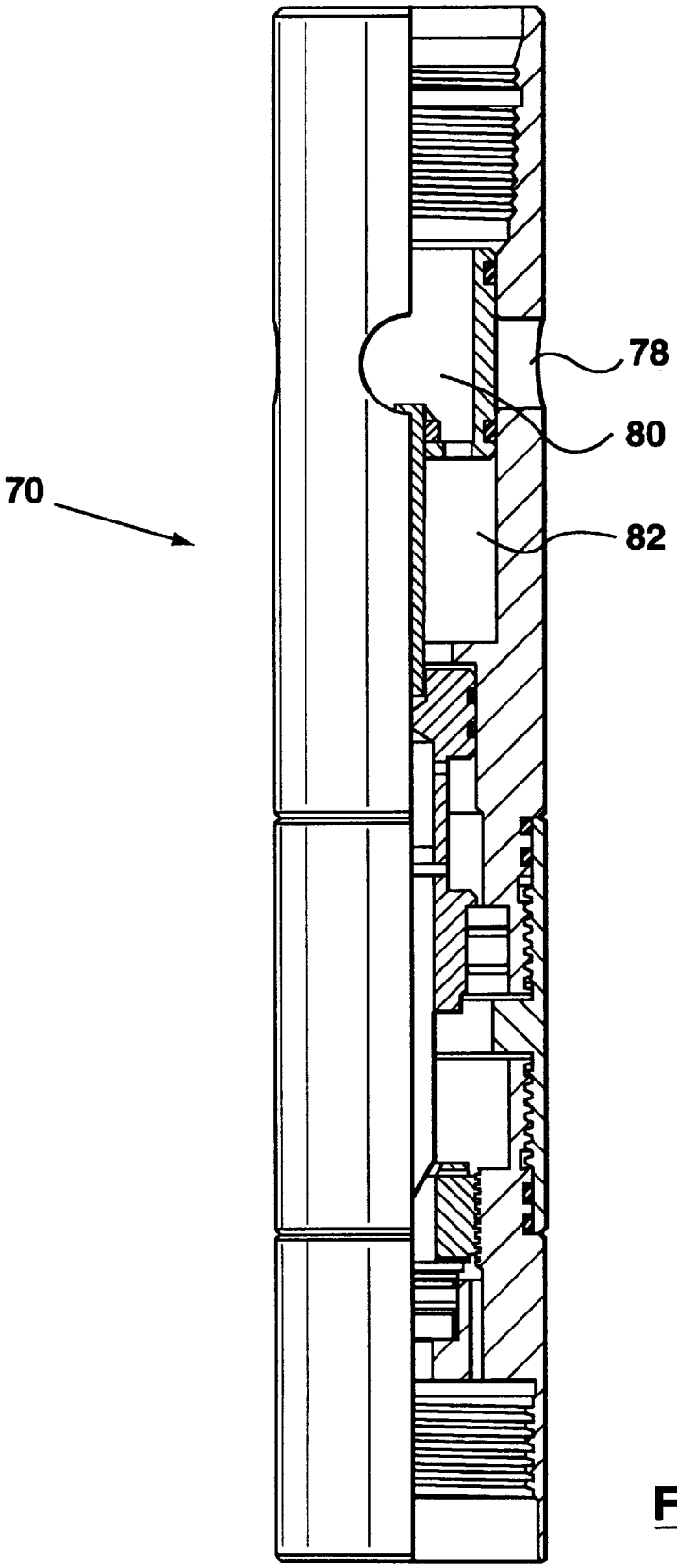
FIG. 11 is a cross-sectional view of the firing head.

FIG. 11 illustrates firing head 70 in its closed position. The firing head vent is set to operate at a predetermined pressure thereby firing the gun and opening the vent. Firing head 70 can be used with time delay fuses to provide time to adjust tubing pressures before the guns can fire. As shown in FIG. 11, ports 78 are obstucted by sleeve 80 when the firing head vent is in its closed position. In operation, sleeve 80 slides downward into recess 82 so as to open ports 78.

Figure 4:
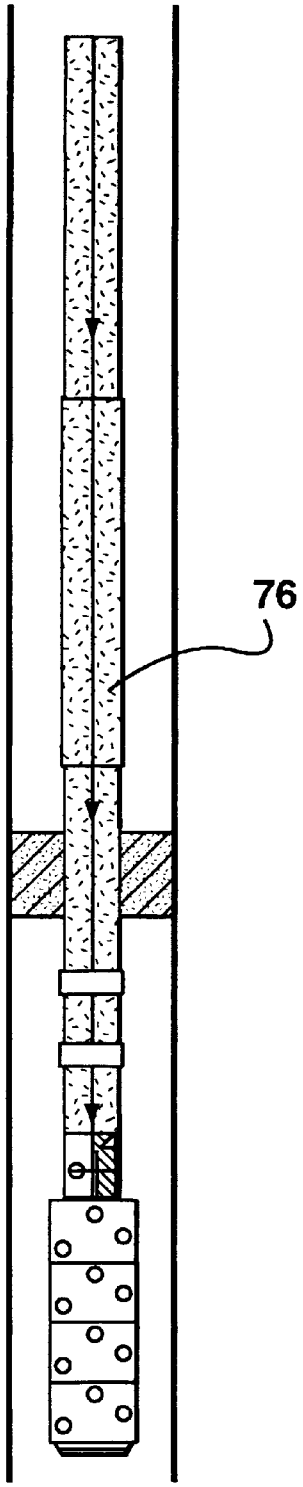
FIG. 4 is a perspective view of the assembly after a volume of nitrogen has been pumped into the tubing.

In FIG. 4, a further volume of nitrogen 76 is pumped into the tubing to build up pressure from the surface. Depending upon the volume of nitrogen which is pumped into the tubing for this purpose, the newly introduced nitrogen displaces part or all of the fluid column 74 in the tubing and the nitrogen and fluid column are pumped through the perforations in the casing and into the formation. The volume of nitrogen which is needed for this purpose varies depending upon the characteristics of the well. For example, one to two tubing volumes of nitrogen might be needed for this purpose. Pumping might not occur at all if fracture extension is not desired.

Figure 5:
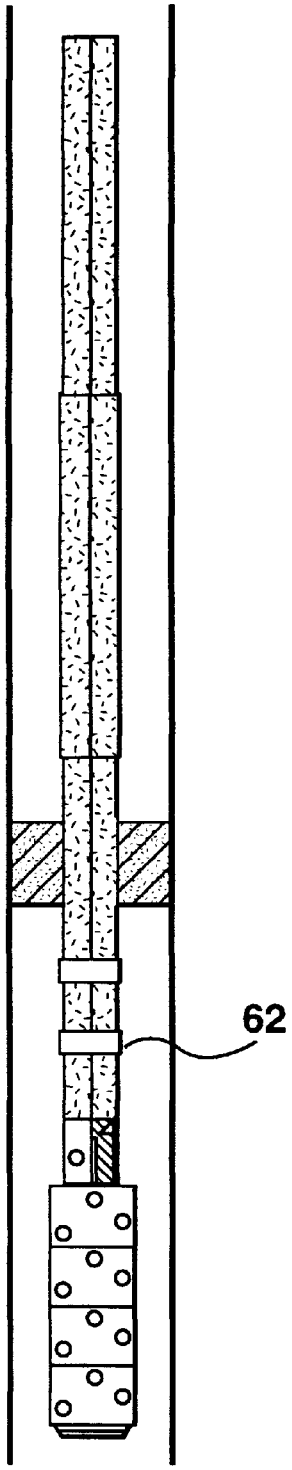
FIG. 5 is a perspective view of the assembly after the check valve has closed.

The downhole pressure should be monitored during the pumping of the nitrogen. When pumping has ceased, the check valve contains pressure below the valve. In FIG. 5, the check valve is now in the closed position. Referring to FIG. 10, the two flappers 64 would be in the horizontal position. The closure of the check valve 62 allows time for the formation to cure and the tubing pressure to be bled down before performing an underbalance surge with the use of a mechanically deployed bar or tube venting device.

Figure 6:
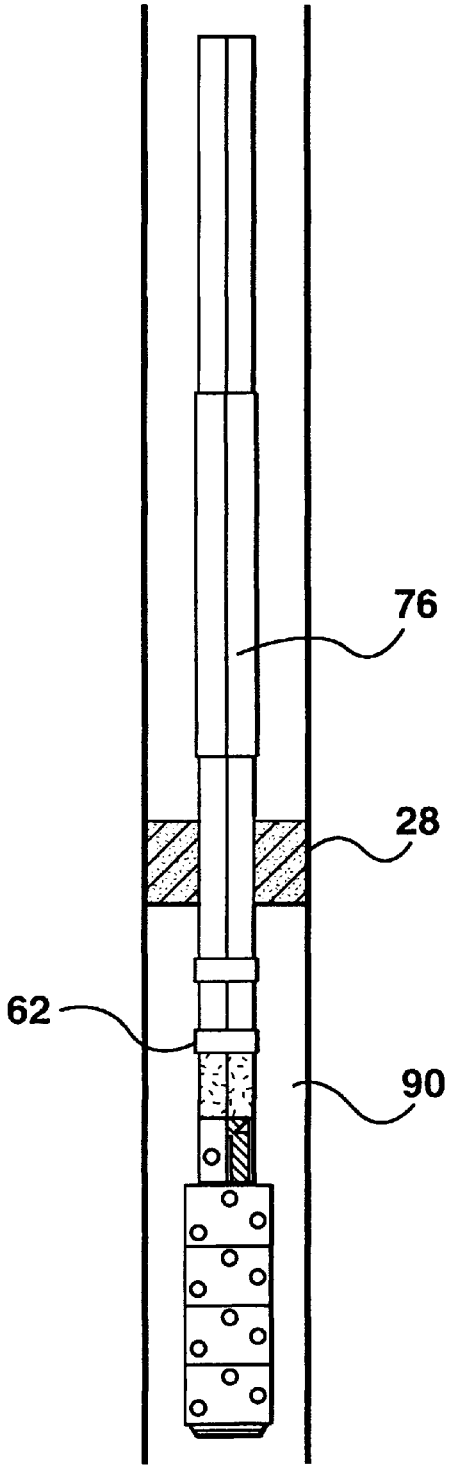
FIG. 6 is a perspective view of the assembly after the nitrogen pressure has been bled out of the tubing, trapping high pressure below the check valve and the packer.

FIG. 6 illustrates the following step. After the check valve tool 62 has closed, the master valve on the surface is opened and pressure is evacuated out of the tubing. Bleeding off the nitrogen pressure out of the tubing creates a zone of high pressure 90 trapped in the region in the tubing below the check valve tool 62 and in the annulus 16 below the packer 28.

Figure 7:
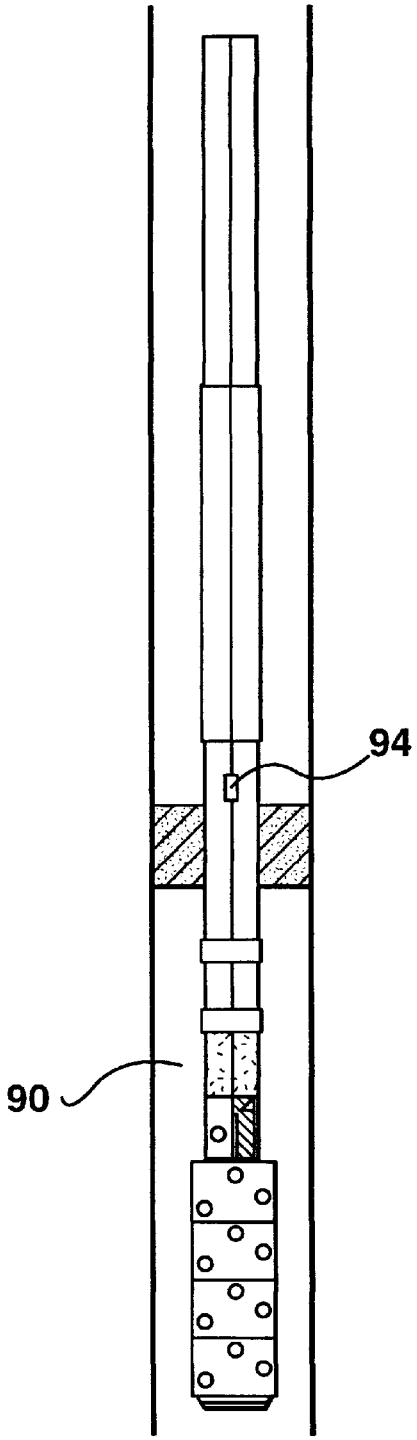
FIG. 7 is a perspective view of the assembly illustrating a drop bar falling within the tubing to initiate the venting device.

As shown in FIG. 7, drop bar 94 is introduced into the tubing such that it falls down inside the tubing and comes into contact with pin 46 in the bar actuated vent. Drop bar 94 is of a cylindrical shape with a flare on top so that it sits below the top of the bar actuated vent but above the check valve. When the drop bar comes into contact with pin 46, the pin breaks and pressure trapped in the cavity together with the aid of spring 56 pushes sleeve 54 upward into a recess 58 in the tool housing, resulting in the opening of ports 50.

Figure 8:
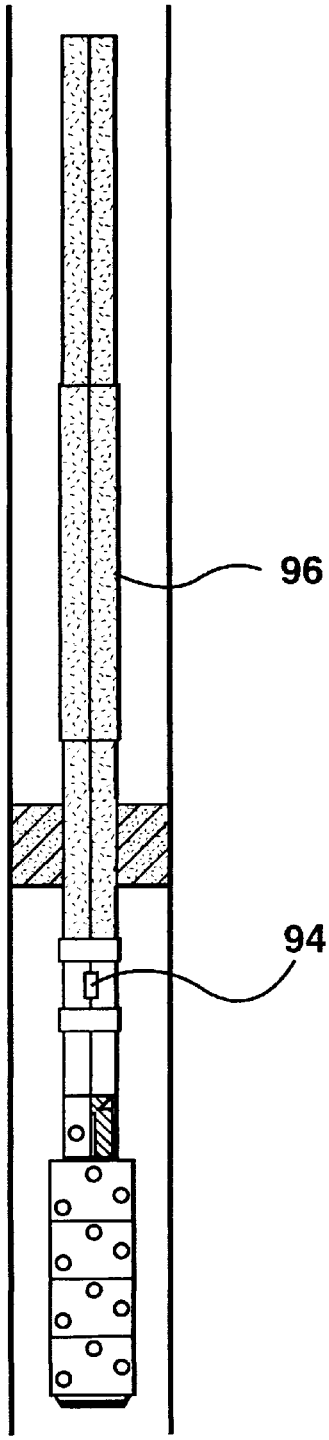
FIG. 8 is a perspective view of the assembly illustrating the surge of a mixture of hydrocarbons and nitrogen through the bar vent and up the tubing to the surface, the drop bar having come to rest after initiating the bar venting device.

As shown in FIG. 8, the opening of the bar actuated vent 42 allows the trapped pressure 90 below the packer to surge into the lower pressure tubing and causes the hydrocarbon/nitrogen mixture 96 to surge up the tubing in the direction of the surface.

The well response is then observed and pressure readings taken at regular intervals.

Several advantages over conventional completion processes become apparent upon an examination of the above description. Unlike the present method, conventional methods do not permit a full underbalance surge to be accomplished. Conventional systems bleed off the gas pressure at surface at the same time that the pressure downhole is slowly being bled of By evacuating all of the pressure out of the tubing and then dropping a bar to open up the vent, a full underbalance surge will take place at the formation.

The process as described herein benefits the production of oil and gas by providing a means to back surge and clean the perforations of mud filtrate, cement contaminates and perforation debris. This surge also cleans the compacted zone surrounding the perforation tunnel, reduces damage to the reservoir rock and allows the oil or gas zone to produce effectively. In contrast with conventional extreme overbalance perforating assemblies, a means to surge the new perforation will now take place.

The foregoing description is given to assist in understanding the invention. It will be readily apparent to those skilled in the art that many variations, applications, modifications and extensions of the basic principles involved in the disclosed invention may be made without departing from its spirit or scope. For example, carbon dioxide is a suitable substitute for nitrogen as is any other product or gas which is able to compress and apply a pressure to the equipment downhole while, at the same time, having physical characteristics that will not damage the formation and will be compatible with formation fluids.

The embodiments of the invention in which an exclusive property or privilege is claimed are defined as follows:

1. A method of completing and producing hydrocarbons in a well, the well having a casing string extending into a wellbore and penetrating a hydrocarbon-bearing formation, a tubing string extending downhole into the casing string, the strings forming an annulus between them which annulus is sealed in one portion by a packer, the tubing string having a bore and ports in its surface located downhole of the packer, the tubing string having valve means located downhole of the ports for selectively trapping or releasing pressure in the tubing string downhole of the valve means, means for perforating the casing string being located at the tubing string's lower end and downhole of the valve means, the casing string initially blocking communication of the hydrocarbons with the wellbore, the method comprising:

blocking the ports in the tubing string so as to prevent fluid communication between the casing string and the tubing string;

creating a fluid column in the tubing string's lower end;

adding a sufficient volume of a gas to the fluid column to achieve a predetermined downhole pressure which will exceed the fracture gradient of the formation;

perforating the casing at the hydrocarbon-bearing formation so as to fracture the formation;

maintaining pressure below the packer through the use of the valve means;

removing sufficient volumes of the gas from the well so that it is in an underbalanced state;

opening the ports so as to release the pressure below the packer and allow it to surge into the tubing string, thus permitting a mixture of hydrocarbons and gas to surge up the tubing string to the surface.

2. The method of claim 1, wherein the gas is nitrogen.

3. The method of claim 1, wherein the gas is carbon dioxide.

4. The method of claim 1, wherein the valve means comprises a flapper valve.

5. The method of claim 1, wherein an additional volume of gas is introduced into the tubing string after perforation to further fracture the formation.

6. The method of claim 2, wherein an additional volume of gas is introduced into the tubing string after perforation to further fracture the formation.

7. The method of claim 3, wherein an additional volume of gas is introduced into the tubing string after perforation to further fracture the formation.

* * * * *